United States Patent [19]

Bulson et al.

[11] 4,007,003

[45] Feb. 8, 1977

[54] PRODUCT AND METHOD OF PRINTING CARPET WITH A TRANSFER PAPER- II

[75] Inventors: Walter T. Bulson; George R. Hartranft; Leonard N. Ray, Jr., all of Lancaster, Pa.

[73] Assignee: Armstrong Cork Company, Lancaster, Pa.

[22] Filed: Sept. 12, 1975

[21] Appl. No.: 612,773

[52] U.S. Cl. ..... 8/2.5 A; 8/14; 68/5 A; 101/470

[51] Int. Cl.[2] ..... D06P 5/20

[58] Field of Search ..... 8/2.5, 2.5 A, 14

[56] References Cited

UNITED STATES PATENTS

| | | | |
|---|---|---|---|
| 2,068,770 | 1/1937 | Schwarzscheld | 8/14 X |
| 3,758,269 | 9/1973 | Bartsch | 8/1 X |
| 3,768,280 | 10/1973 | Kannegiesser | 8/2.5 |
| 3,782,896 | 1/1974 | Defago | 8/2.5 |
| 3,837,796 | 9/1974 | Fleissner | 8/2.5 |
| 3,874,846 | 4/1975 | Ashe | 8/2.5 |
| 3,880,579 | 4/1975 | Renaut | 8/2.5 |
| 3,949,574 | 4/1976 | Glover | 8/2.5 |

FOREIGN PATENTS OR APPLICATIONS

| | | | |
|---|---|---|---|
| 819,049 | 2/1975 | Belgium | 8/2.5 |

OTHER PUBLICATIONS

Ciba Review, Jan. 1967, pp. 47–51 and 1970, pp. 53–55.

*Primary Examiner*—Donald Levy

[57] ABSTRACT

A pattern is placed on a porous transfer sheet by the use of sublimable dyes. Carpet face yarns are tufted into a backing material. The transfer sheet is placed adjacent the back of the carpet on the side of the carpet opposite from the carpet face yarns. Heated air causes the sublimable dye to move from the transfer sheet, through the carpet backing to the face yarns of the carpet to provide the dye pattern on the face yarns.

3 Claims, 2 Drawing Figures

PRODUCT AND METHOD OF PRINTING CARPET WITH A TRANSFER PAPER- II

CROSS-REFERENCE TO RELATED APPLICATIONS

This application is directed to improvement over the application of Walter T. Bulson et al entitled "Product and Method of Printing Carpet With a Transfer Sheet", which was filed Sept. 12, 1975 as application Ser. No. 612,908.

BACKGROUND OF THE INVENTION

1. Field of the Invention

The invention is primarily directed to a technique for printing carpet, and more particularly, to a printing technique that uses sublimable dyes on a transfer sheet that is placed adjacent the back of the carpet for printing a pattern on the carpet face yarns.

2. Description of the Prior Art

U.S. Pat. No. 3,782,896 discloses it is old to use transfer printing operations to print carpet designs.

Transfer printing through the use of sublimable dyes is an old art. Normally, the dye is carried on a transfer carrier or sheet and the transfer carrier is placed up against the surface to be dyed. Through the use of heat and pressure, the sublimable dyes are converted to a vapor stage and transferred to the material adjacent the transfer carrier. The transfer carrier is then usually discarded. Normally, the transfer carrier is non-porous. Also, the prior art suggests the use of vacuum to achieve greater depth of printing.

U.S. Pat. No. 3,707,346 teaches the above concept of transfer printing and suggests the use of a heated roll, a heated plate, or steam or dry, warm air under atmospheric pressure or in a vacuum to cause transfer printing.

The inventive technique herein is the utilization of a porous transfer carrier or sheet for the printing of the face yarns of a carpet. Herein, specifically, the transfer is carried out through the use of a heated gas which is controlled as to its temperature and flow so as to provide controlled displacement of the sublimable dyes from the porous transfer sheet to the face carpet yarns of the finished carpet product. The transfer sheet is not positioned adjacent the face carpet yarns of the carpet product, but is placed against the back of the carpet product.

SUMMARY OF THE INVENTION

A conventional carpet structure is provided. This carpet structure consists of a carpet backing which has on one side thereof a facing of carpet yarn tufted into the carpet backing. The carpet yarn of the facing may be tufted to multi levels or may be a single level. A porous transfer sheet is provided with a pattern printed thereon through the use of inks containing sublimable dyes. After the inks have had an opportunity to dry, the transfer sheet is placed adjacent the carpet backing with the printed design adjacent the carpet backing. Heated air is then passed through the combination in the direction from the transfer sheet, through the carpet backing to the face fiber yarns. This causes the sublimable dyes on the transfer sheet to change to a vapor phase and be transferred from the transfer sheet to the carpet face yarn. There then results a product which is composed of a carpet backing and face fiber yarns containing a decorative pattern thereon.

DESCRIPTION OF THE PREFERRED EMBODIMENT

The process herein is carried out by basically the following steps. A porous transfer sheet is provided with a design printed thereon by a conventional Zimmer printer, utilizing inks containing sublimable dyes. Printing can be carried out by any commercially available printer as long as it places the different inks in position in register. The printed transfer sheet is permitted to dry. A conventional carpet yarn is tufted into a conventional carpet backing by conventional tufting machinery. The piles or loops or face fiber yarns of the finished tufted yarn carpet will be on one side of the carpet backing. The face fiber yarns of the carpet may be in one level, but preferably will be at two or more levels. The face of the transfer sheet with the design printed thereon is then placed adjacent the carpet backing on the side thereof opposite from the side of the carpet backing containing the face fiber yarns. That is, the transfer sheet will be placed in contact with the back of the carpet backing. The transfer sheet-carpet assembly is then subjected to a heated air treatment wherein air is passed through the porous transfer sheet, through the carpet backing and then through the face fiber yarns of the carpet. At this time, the pattern printed on the transfer sheet is transferred therefrom and fully developed throughout the height of the pile of the face fiber yarns of the carpet. This then produces a carpet product which has a backing and yarn tufted into the face thereof with the yarn being dyed in a selected pattern. The design of the product herein is slightly diffused as compared with the design that one would secure by printing with the technique of the above-mentioned copending application. Particularly if the carpet face fiber yarns are tufted into the carpet backing with multi levels, to form a sulptured pile the technique herein is preferable in use over the transfer printing technique of the above-mentioned copending application. Herein the transfer sheet will be placed against the backing of the carpet and thus will rest against a uniform level surface. If the printing technique of the above-mentioned copending application was carried out, the transfer sheet would have to be placed against the carpet face fiber yarns which are of different levels and, therefore, the transfer sheet in some spots would be in contact with some of the face fiber yarns, but in other areas spaced from the lower level face fiber yarns. This lack of a uniform spacing on the transfer sheet from the irregular surface of the face fiber yarn can be undesirable in some circumstances because it may result in loss of registration or result in loss of pattern.

Figure 1:
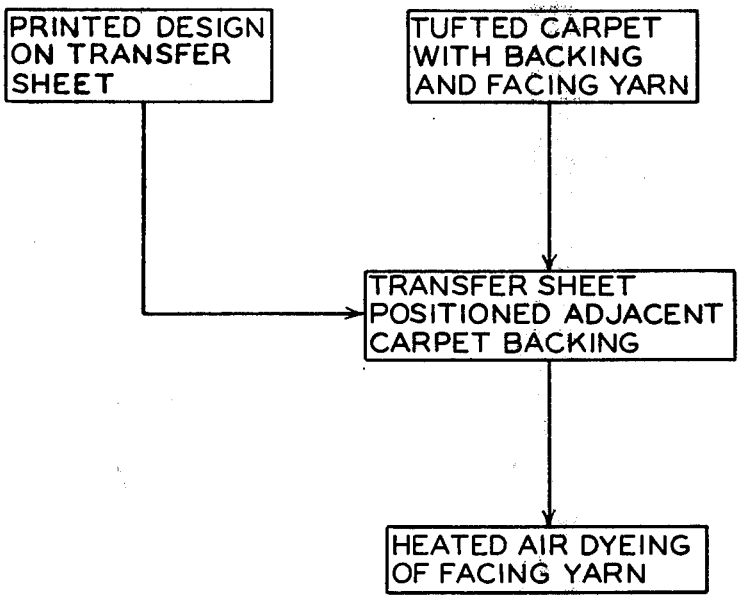
FIG. 1 is a schematic view of the process herein.
Figure 2:
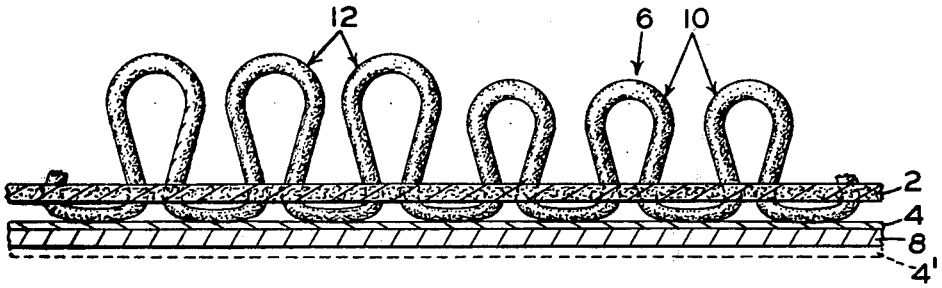
FIG. 2 is a cross-sectional view of the product of the invention herein.

In one specific example of the invention, a carpet product is made with a conventional jute carpet backing with a 19 × 19 count. The 19 × 19 count is the number of yarns in the warp and woof direction of the backing. The aforesaid jute weighs approximately 6 ounces per square yard. The jute has an air permeability of 650 standard cubic feet per minute per square foot 198 standard cubic meters per minute per square meter). Nylon 66 yarn, Dupont Type 846, 1300 denier, bulk continuous filament yarn is then tufted into the jute using a 5/64 inch (0.2 cm) gauge, 12 tufts per inch, to produce a 1/8 inch (.3 cm) pile level loop carpet weighing 13 ounces per square yard (441 g. per square meter). This then yields a carpet product similar to that shown in FIG. 2 wherein the carpet backing or scrim 2 is provided with tufted yarn 6. Porous glass fiber paper which is a non-woven material weighing 2.7 ounces per square yard (91.5 g. per square meter) with an air permeability of 208 standard cubic feet per minute per square foot (63 standard cubic meters per minute per square meter), is then printed on a Zimmer printer with inks containing sublimable dyes. Specifically, the dyes being used as Latyl Cerise NSW, C.I. Disperse No. Red 60, C.I. Constitution No. 60756, and Latyl Yellow 3G, C.I. Disperse No. Yellow 54, C.I. Constitution No. 47020. The design printed on the glass fiber paper may be any type of aesthetic design and after it is printed on the transfer paper with the above-said sublimable dyes, the dyes are permitted to dry. The printed paper is then placed adjacent the nylon carpeting with the printed surface of the transfer paper near or in contact with the carpet scrim or backing 2. This is shown in FIG. 2 wherein the transfer sheet 8 is provided with a design 4 and the design 4 is placed in contact with the carpet scrim 2. Alternately, the transfer paper is placed in contact with the carpet scrim with the printed design positioned on the back side of the scrim 8 so that the printed design will be facing away from the carpet backing and in the position 4′ shown in FIG. 2.

The above product is then passed through a chamber where air, at 425° F. (218° C.), may be passed through the transfer sheet and the carpet in the direction from the transfer sheet through the scrim of the carpet and out through the face fiber of the carpet. The air flows at a rate of 15 cubic feet per minute per square foot (5 cubic meters per minute per square meter) and the transfer sheet and carpet are subjected to this air flow for 3 minutes. In this time, the pattern printed on the glass paper is transferred to the carpet face fiber and fully developed through the depth of the pile of the carpet face fiber. The print has a reasonably sharp appearance, but more diffused than one would secure by printing with the technique in the above-mentioned copending application and is brightly colored.

In addition to using jute as the backing material for the carpet, the invention has been carried out using backing materials of glass fiber and woven and non-woven polypropylene. In addition to using Nylon 66 as the carpet face yarn, the invention has also been carried out using Nylon 6, acrylic and polyester fibers as the carpet face yarn. The invention has been carried out with carpeting of a denser construction than that described above and has been utilized with carpet backing having tufted thereinto face yarns of as high as ¼ inch (0.6 cm) gauge, 5 tufts per inch, to produce a pile height of 1 inch (2.5 cm) with a carpet face fiber weight up to 48 ounces per square yard (1.6 kg per square meter). The invention has been carried out using not only glass fiber paper as the transfer sheet, but also transfer sheets made of jute, cellulosic-glass fiber paper, cellulosic paper, and spun-bonded polyester. In every case, the transfer sheet is a porous material.

The invention has been carried out with an air flow rate of as low as 10 standard cubic feet per minute per square foot (30 standard cubic meters per minute per square meter) and as high as air flow as 120 standard cubic feet per minute per square foot (37 standard cubic meters per minute per square meter), for a carpet construction of a pile height of 1 inch (2.5 cm) with a carpet face weight up to 48 ounces per square yard (1.6 kg per square meter). It would appear that the air flow upper limit is determined by the output capability of the air moving means and the air flow rate is selected based upon the scrim material used, face fiber used, dye used, operating temperature and desired production speed. Naturally, the porosity of the transfer sheet also influences to some extent the air flow.

The invention need not be restricted to just the use of heated air to cause the sublimable dyes to transfer, but the invention can also be carried out through the use of superheated steam. Other gases could be utilized, and it would appear that the three primary purposes of the gas utilized as (1) to cause the dye to change to a vapor, (2) to move the vapor phase dye through the carpet face yarn from the back to the front of the carpet facing, and (3) to facilitate diffusion of the dye into the fiber.

Successful transfer printing has been carried out with temperatures as low as 300° F. (149° C.) for the heated air. This has required long printing times, in the range of 10 minutes or more. Since the vapor pressure of sublimable dyes is a function of temperature, it is obvious that the temperature used is primarily a function of the dye being utilized, but in some carpet constructions the temperature used may be selected because of a heat-sensitive element in the carpet construction.

Three primary dyes have been utilized for most work to date. Many other dyes may be utilized. As set forth in the above-mentioned copending application, the three basic dyes may be utilized to form a number of different colors. In addition to the basic dyes, as set forth in the above-mentioned copending application, other dyes may be utilized. The inks containing the dyes are prepared in a conventional manner and this is set forth in the above-mentioned copending application. The different dyes which have been utilized or which may be utilized and the forming of the inks which have been utilized are spelled out in detail in the above-mentioned copending application and this information is incorporated by reference herein.

In another example of the invention, a carpet product is made with a conventional jute carpet backing with a 19 × 19 count. The 19 × 19 count is the number of yarns in the warp and woof direction of the backing. The aforesaid jute weighs approximately 6 ounces per square yard (203 g. per square meter). Nylon 6 yarn, 1750 denier spun yarn is then tufted into the jute using a 3/16 inch (0.48 cm) gauge, 30.5 stitches per 3 inches (7.6 cm) to produce a 13/32 inch (1.03 cm) sheared pile carpet weighing 43 ounces per square yard (1.41 kg per square meter). Porous glass fiber paper which is a non-woven material weighing 2.7 ounces per square yard (92 g. per square meter) is then printed on a Zimmer printer with inks containing the sublimable dyes above-mentioned in the first example. The printed paper is placed adjacent the nylon carpeting with the printed surface of the transfer sheet near or in contact with the carpet scrim. This is shown in FIG. 2 wherein the transfer sheet 8 is provided with a design 4 and the design 4 is placed in contact with the carpet scrim 2.

The above product is then passed through a chamber where air, at 400° F. (204.4° C.) may be passed through the transfer sheet and the carpet in the direction from the transfer sheet through the carpet scrim and out through the face fiber of the carpet. The air flows at a rate of 30 cubic feet per minute per square foot (9 cubic meters per minute per square meter) and the transfer paper and carpet are subjected to this air flow for 3 minutes. In this time, the pattern printed on the glass paper is transferred to the carpet face fibers and fully developed throughout the depth of the pile of the carpet face fiber. The print has a soft, diffused appearance and is brightly colored.

In still another example of the invention, a carpet product is made with a conventional jute backing with a 13 × 15 count. The 13 × 15 count is the number of yarns in the warp and woof direction of the backing. The aforesaid jute weighs approximately 9 ounces per square yard (305 g. per. square meter). Nylon 6 yarn, Allied Chemical 15U2XA5, 1750 denier, bulk continuous filament yarn is then tufted into the jute using a 3/16 inch (0.48 cm) gauge, 30.5 stitches per 3 inches (7.6 cm), tuft length of 1 inch (2.5 cm) and then sheared to produce a carpet with a pile height of 13/32 inch (1.03 cm) weighting 43 ounces per square yard (1.46 kg per square meter). While this product happens to have a level pile construction, it is possible that the product could be made with a multi-level pile construction. By that is meant that the product would be made with some loops (pile) at a level as shown by loops (pile) 10 and other loops (pile) 12 at a higher level. This then provides a carpet structure which has the loops (pile) therein at two different levels. Such a carpet is well known in the carpeting industry and is normally referred to as multi-level carpet or sometimes sculptured carpet. Porous glass fiber paper which is a non-woven material weighing 2.7 ounces per square yard (92 g. per square meter) and having an air permeability of 208 standard cubic feet per minute per square foot (63 standard cubic meters per minute per square meter), is then printed on a Zimmer printer with inks such as those described in the first above given example. The printed transfer sheet is then placed adjacent the nylon carpeting with the printed surface of the transfer sheet near or in contact with the carpet scrim. This is shown in FIG. 2 wherein the transfer sheet 8 is provided with a design 4 and the design 4 is placed in contact with the carpet scrim 2.

The above product is then passed through a chamber where air, at 425° F. (218° C.) may be passed through the transfer sheet and the carpet in the direction from the transfer sheet through the carpet scrim and out through the face fiber of the carpet. The air flows at a rate of 15 cubic feet per minute per square foot (5 cubic meters per minute per square meter) and the transfer sheet and carpet are subjected to this air flow for 3–4 minutes. In this time, the pattern printed on the glass paper is transferred to the carpet face fiber and fully developed throughout the depth of the pile of the carpet face fiber. The print has a soft, diffused appearance and is brightly colored.

The final example herein is made the same way as the first aforesaid described carpet fabric made with a jute backing and a Nylon yarn with a glass fiber paper except for the following differences. The transfer paper being utilized is a porous glass fiber paper weighting 2.7 ounces per square yard (91.5 g. per square meter) and having an air permeability of 208 standard cubic feet per minute per square foot (63.4 standard cubic meters per minute per square meter). This transfer sheet is used on an acrylic carpet yarn which is 1700 denier and is sold under the trade name "Creslan Acrylic CS Type 83" by American Cyanamid Company. The acrylic material is tufted into the carpet backing to provide 25 ounces per square yard (847.7 g. per square meter) of face yarn on the carpet scrim, to produce a 13/32 inch (1.032 cm) pile height. During processing, the porous glass fiber paper transfer sheet and the acrylic carpet face yarn are processed in a chamber where air, at 425° F. (218° C.) may be passed through the transfer paper and the carpet in the direction from the transfer sheet through the carpet scrim and out through the face fiber of the carpet. The air flow rate is at about 15 cubic feet per minute per square foot (5 cubic meters per minute per square meter) and the transfer paper and carpet are subjected to this air flow for 3 minutes. In this time, the pattern printed on the transfer paper is transferred to the carpet face fiber and fully developed throughout the depth of the pile of the carpet face fiber. The print is sharply defined and brightly colored.

Based upon experimentation to date, it is believed that through the use of the above-described different transfer sheets, different carpet face fibers and different dyes, it is possible to make a product through the use of an air flow rate as low as 10 standard cubic feet per minute per square foot (3.0 standard cubic meters per minute per square meter) and preferably from 10 to 120 standard cubic feet per minute per square foot (3.0 to 37 standard cubic meters per minute per square meter). The transfer may be carried out through the use of different gaseous mediums which may be heated anywhere in the range of about 300° to 450° F. (149°–232° C.), primarily depending upon the dyes being utilized and the sensitivity of the carpet components to temperature. The time for transfer of the dye may take anywhere from about 30 seconds to 15 minutes, but should preferably occur within a 30 -second to 5-minute time span.

As was indicated above, the technique herein differs from the technique of the above-mentioned copending application and provides a carpet with a softer, more diffused pattern on the face fiber yarns. As was indicated above, with some carpet structures, such as multi-level carpet structures or very deep shag carpet structures, it is preferable to place the transfer sheet against the relatively level carpet backing rather than the relatively irregular carpet face yarns to carry out the transfer printing operation.

What is claimed is:

1. A process for making a decorative carpet through the use of sublimable dyes comprising the steps of:

a. printing sublimable dyes on a porous transfer sheet, b. preparing a carpet prouct which has on one side thereof carpet yarn forming the face fiber yarns with an irregular surface to form a sculptured pile c. placing the transfer sheet adjacent the back of the carpet product on the side of the carpet product opposite from the side of the carpet product having the face fiber yarns so that the transfer sheet with the sublimable dyes printed thereon will be adjacent the back of the carpet product, and d. transferring the sublimable dyes from the transfer sheet to the carpet face yarn through the application only of a directional flow, heated gaseous medium passing through the transfer sheet and the carpet product in the direction from the transfer sheet towards the back of the carpet product and out the face fiber yarn side of the carpet product.

2. A process for making a decorative carpet according to claim 1 wherein the directional flow, heated gaseous medium is supplied at a flow rate as low as about 10 standard cubic feet per minute per square foot and preferably 10 to 120 standard cubic feet per minute per square foot and the porosity of the transfer sheet and carpet product is sufficient to permit the passage of the gaseous medium therethrough at the aforesaid flow rates.

3. The process for making a decorative carpet as set forth in claim 2 wherein the gaseous medium is supplied at a temperature ranging from about 300° to 450° F. and the dye transfer time ranges from about 30 seconds to 15 minutes.

* * * * *